US006880466B2

(12) United States Patent
Carman

(10) Patent No.: US 6,880,466 B2
(45) Date of Patent: Apr. 19, 2005

(54) SUB-LETHAL, WIRELESS PROJECTILE AND ACCESSORIES

(76) Inventor: Brent G. Carman, 629 E. Moulton St., Hickman, KY (US) 42050

( * ) Notice: Subject to any disclaimer, the term of this patent is extended or adjusted under 35 U.S.C. 154(b) by 0 days.

(21) Appl. No.: 10/600,679

(22) Filed: Jun. 20, 2003

(65) Prior Publication Data

US 2005/0039628 A1 Feb. 24, 2005

Related U.S. Application Data

(60) Provisional application No. 60/391,456, filed on Jun. 25, 2002.

(51) Int. Cl.[7] ..... F42B 30/02

(52) U.S. Cl. ..... 102/502; 361/232; 42/1.08; 119/908

(58) Field of Search ..... 102/502, 293; 361/232; 89/1.11, 1.1; 42/1.08; 463/47.3; 119/908, 174

(56) References Cited

U.S. PATENT DOCUMENTS

| | | | | | |
|---|---|---|---|---|---|
| 2,805,067 | A | | 9/1957 | Ryan | |
| 3,523,538 | A | * | 8/1970 | Kunio | 607/58 |
| 3,803,463 | A | | 4/1974 | Cover | |
| 3,921,614 | A | | 11/1975 | Fogelgren | |
| 4,073,280 | A | * | 2/1978 | Koehn et al. | 124/72 |
| 4,120,305 | A | * | 10/1978 | Rhoads et al. | 607/58 |
| 4,204,474 | A | * | 5/1980 | Mizelle | 102/502 |
| 4,253,132 | A | | 2/1981 | Cover | |
| 5,153,365 | A | * | 10/1992 | Chang | 89/1.11 |
| 5,473,501 | A | * | 12/1995 | Claypool | 361/232 |
| 5,698,815 | A | | 12/1997 | Ragner | |
| 5,737,863 | A | * | 4/1998 | Rainey, III | 42/51 |
| 5,750,918 | A | * | 5/1998 | Mangolds et al. | 102/502 |
| 5,831,199 | A | * | 11/1998 | McNulty et al. | 89/1.11 |
| 5,962,806 | A | | 10/1999 | Coakley et al. | |
| 6,636,412 | B1 | * | 10/2003 | Smith | 361/232 |
| 6,679,180 | B1 | * | 1/2004 | Warnagiris et al. | 102/502 |
| 2003/0159572 | A1 | * | 8/2003 | Downs | 89/1.11 |
| 2004/0017178 | A1 | * | 1/2004 | Chang | 320/114 |

FOREIGN PATENT DOCUMENTS

GB 2 384 042 A * 7/2003

* cited by examiner

*Primary Examiner*—Michael J. Carone
*Assistant Examiner*—James S. Bergin
(74) *Attorney, Agent, or Firm*—Stephen R. Chapman

(57) ABSTRACT

The invention is a circuit capable of being positioned in a variety of wireless projectile and of delivering a series of pulsed electric discharges in two wave frequencies so as to stun and disable a target individual. The projectiles are adapted to be discharged from a different types of devices and powered by explosive, pneumatic, or manual means. At least one mode includes the ability to deliver a stunning physical blow in addition to the electric shock. The device is sub-lethal, but totally disabling in effects on a target individual.

2 Claims, 7 Drawing Sheets

SUB-LETHAL, WIRELESS PROJECTILE AND ACCESSORIES

RELATED APPLICATIONS

This application claims the benefit of U.S. Provisional Patent Application Ser. No. 60/391,456 filed Jun. 25, 2002, and which is incorporated herein by reference.

FIELD OF THE INVENTION

This invention is directed to sub-lethal, wireless projectiles capable of delivering a disabling electrical shock to a target individual under a variety of settings and conditions. More specifically it is directed to a circuit that can be positioned in a wireless projectile and can deliver a series of sub-lethal, pulsating, disabling electrical shocks. The circuit delivers energy in at least two different bands to disable by at least one of the following: target individual's natural reaction to pain, loss of muscular control of target individual, disorientation suffered by target individual, and loss of balance of target individual.

BACKGROUND OF THE INVENTION

Recent acts of terrorism in the United States have generated renewed interest in and increased demands for devices or systems that are capable of disabling a target individual with sub-lethal force with emphasis on minimizing danger to innocent by-standers or damage to structures, particularly air craft. Prior to the terrorists' act of September, 2001, civilian law enforcement professionals recognized a need for a non-lethal device capable of disabling a target individual in a crowd while minimizing danger to by-standers in the event the device failed to hit the intended target. The United States military has similarly recognized the need for a wireless, stun projectile for riot control. Electrical devices have been used for such purposes with limited effectiveness.

An early use of electrical energy in weapons focused on the control of animals. U.S. Pat. No. 2,805,067 to Ryan issued Sep. 3, 1951 described increased effectiveness of an apparatus used in surprise attacks by combining a non-explosive missile with an electrical system capable of delivering a disabling to fatal shock to the target. The '067 patent claims anticipated applications only to animals, not to human targets. The shocking device was integrated with a hand-held device, such as a lance-like weapon.

Others have recognized the potential value of non-lethal types of devices. U.S. Pat. No. 3,921,614 to Folgelgren issued Nov. 25, 1975 describes and claims a compressed-gas operated hand gun capable of firing lethal and non-lethal projectiles. The '614 patent includes as an example one embodiment comprising a projectile that, on contact with a target, discharges one of several stunning substances, such as tear gas, flash powder, or wadding. The '614 patent fails to address the effect of the projectile glancing off of a target or otherwise failing to discharge the stunning material in an effective concentration in proximity to the target, or the impact on innocent by-standers.

The basic concept suggested in the '067 patent of electrical energy as an element of a stunning or disabling force to be delivered by a weapon re-emerged with significant effectiveness in what is known as Taser technology. The Taser is a hand-held, self-defense device that supplies a stunning electrical charge and a projectile that remains connected to the device. The electrical charge is delivered to the target by electrodes positioned in the projectile. The effective range of the Taser is limited to 4.5–6.7 m (about 12–15 ft). In addition the device or weapon is limited to a single shot because the projectile must remain wired to the power-source weapon. The basic power supply for the remote system is described in U.S. Pat. No. 4,253,132 issued Feb. 24, 1981 to Cover, and details of the power providing device and projectile firing weapon are described in U.S. Pat. No. 3,803,463 issued Apr. 7, 1974 to Cover.

Certain short comings and limitations of the Taser device are addressed by U.S. Pat. No. 5,698,815 issued Dec. 16, 1997 to Range and by U.S. Pat. No. 5,962,806 issued Oct. 5, 1999 to Coakley, et al. Both the '815 and '806 patents describe wireless projectiles capable of delivering a non-lethal, stunning shock of a single frequency at a relatively high voltage. The projectile of both the '815 and the '806 patents comprises a complex electrical system, including a power source to supply the relatively high voltage requirements. The shock is delivered through electrodes that do not penetrate the skin of the target individual. The 815 patent features an adhesive capsule that serves to secure the projectile to the clothing or skin of the target individual. The 806 patent depends on mechanical appendages of the projectile to secure the projectile to the clothing of the target individual.

The physiological fact that an electrical shock delivered in two bands, one causing pain and the other inducing paralysis of the nervous system is not recognized by the '816 patent, the '806 patent, or by the Taser technology. The fact that penetrating the skin allows effective use of significantly lower voltage to induce the stunning effects is not recognized.

A variety of non-lethal projectiles has been described. Many are well known to the military, to law enforcement agencies, and even to the public. They include devices such as rubber and relative soft synthetic bullets to be fired from standard fire arms, and bean bags (or soft, flexible containers of solid loosely packed pellets) adapted to be discharged generally from smooth bore weapons.

The '806 patent recognizes the importance of projectile stability in flight for accuracy in use and describes the projectile body as a cylinder made of plastic or resin impregnated cardboard. Similarly, the '815 patent describes the projectile housing or body as a single, molded piece of high-impact plastic. Neither the '806 patent nor the '815 patent address basic issues of projectile ballistics in any detail, including discharge velocities, projectile energy, and the potential stunning effects of the impact of the projectile on the target individual. Prior art related to sub-lethal devices ignores characteristics of projectiles that related to safety of use in certain confined areas, such as the cabin of an aircraft.

Accordingly, there remains room for improvement in an electrical circuit for a sub-lethal projectile to deliver an electrical shock in more that one frequency and deliver the shock by means of electrodes that penetrate the skin, thereby requiring greatly reduced electrical potential in the circuit. There also remains room for improvement in the design of sub-lethal, wireless projectiles capable of delivering a disabling shock in terms of the maximum impact on a target and in terms of safety of use in confined areas.

SUMMARY OF THE INVENTION

A goal of the invention is device % capable of delivering a disabling, sub-lethal electrical shock to a target individual by means of a wireless projectile or similar device that includes a circuit that functions on stored power, independent from an external charging power supply source. To this end, a further goal of the invention is an electrical circuit capable of storing electrical energy and capable of stepping-up and discharging the stored energy in two frequencies in a series of pulsating, discharges. The circuit is adapted to being positioned in a projectile and adapted to being charged by an external power source. A further goal is a projectile capable of being discharged from various types of weapons using explosives or gas pressure as a propellant or being propelled by hand and is further adapted at or near the ground level to serve as a security barrier. A further goal of the invention is a device to store the projectiles so that it is readily accessible for use and to allow each stored projectile to conveniently be charged by an external power supply.

These and other goals of the invention are achieved by a wireless projectile that includes a circuit capable of receiving and holding or storing an electrical charge from an external source and further capable of generating and delivering a shock from the stored electrical charge and also by a wireless projectile that in addition includes a housing or body in which the circuit is positioned, with shock delivering electrodes extending from the front of the body, and the projectile further being adapted to being fired from various types of weapons using explosives or gas pressure as a propellant., or being thrown by hand, and in addition, the body having structures such as fins and ridges that serve as rifflings to stabilize the projectile in flight. Moreover, these and other goals are further achieved by an electric circuit adapted for charging by an external power source and having two oscillators, each connected to the power source for charging and specific power output connections, and further a capacitor capable of being charged and capable of outputting its stored charge, plus a timing circuit and analog switch that controls power flow, and in addition controller and amplifier elements with power input and output capabilities and being connected to at least one oscillator and further being functionally connected to the analog switch; in addition a proximity sensor is functionally connected to the timing switch and to members of at least one pair of electrodes, with the ground electrode connected to proximity sensor and the other electrode connected through the analog switch. These and other goals of the invention are further achieved by a sub-lethal, wireless projectile with an electrical power storage element that is charged from an external power supply and that includes a circuit system that regulates the delivery the magnitude and frequency of pulsating shocks that are delivered to a target individual by means of electrodes that can penetrate clothing and penetrate the skin of the target individual with the entire electrical system positioned in a cylindrical body or cartridge with the electrodes extending from its tip and, in addition to the delivery of the shock, the cartridge delivers a physical blow to the target individual on contact. The goals of the invention are still further achieved by a cartridge that includes a propellant and primer so that the cartridge can be discharged by a weapon thereby launching a sublethal projectile positioned in the cartridge. In addition, the goals of the invention are further achieved by a device that holds the sub-lethal projectiles positioned in cartridges so that they can be connected to and charged by an external power source.

These and other goals, features, aspects, and advantages of the present invention will become better understood by reference to the following description, figures, and appended claims.

Concepts Explaining a Disabling Electrical Shock

Alternating current (AC) is approximately three- to five-fold as effective as direct current (DC) in shocking ability using the same voltage and amperage; thus, the following discussion will focus on AC, including pulsed DC that behaves as AC. See Robert Berkow, Editor, "The Merck Manual," 15th edition (1987), Merck, Sharp, & Dohme Research Laboratories, Rahway, N.J., chapter 258 of which is hereby incorporated by reference in its entirety. An electrical system capable of delivering an optimal, disabling electric shock to a target individual must effectively combine several basic properties of electrical energy. The effectiveness of a shock measured by its capacity to disable a target individual cannot be well characterized by any single characteristic of electrical energy, but effectiveness involves complex combinations of several basic aspects of electrical energy.

Voltage (V) is a basic aspect of electrical energy and it describes the difference in electrical potential between two points. Taken alone, voltage does not explain the disabling effects of an electrical shock, but current will not flow in the absence of a difference in potential (voltage) and no shock can occur. For a detailed discussion of voltage and related phenomena, see Douglas C. Giancoli, "Physics Principles with Applications, 5th Ed., 1998, Prentice Hall, Upper Saddle River, N.J., chapters 16, 17, 18, and 19 of which are hereby incorporated in their entirety, by reference.

Voltage does not accurately directly reflect kinetic energy. The actual amount of kinetic energy acquired in conversion from potential energy to kinetic energy depends on the magnitude of V and on the electrical charge that flows across the potential. The charge (conceptually the electrical mass) is measured in amperes (A), the recognized unit of current and is defined in terms of a magnetic field produced using a defined value for a single ampere.

The production and disabling action of an electrical shock are functions of two aspects of electricity: power and energy. Energy is the ability to do work, and power is defined as conversion of energy from one form to a different form, conveniently expressed in watts (W) (or kilowatts). Watts are the product of the current passing through a device (A) and the potential (V), or $I=A\times V$. See in general, Giancoli, "Physics," 5th Ed. 1998. Prentice Hall, Upper Saddle River, N.J. incorporated herein by reference.

A difference in potential is required to produce an electrical current in a circuit. The magnitude of the current flow in the circuit depends on the difference in potential (V) and on the resistance to flow in ohms. The delivery of a disabling electrical shock requires current flow either essentially at the skin surface of the target individual or, if electrodes between which the circuit is to be completed penetrated the skin, through the subdural layers. Resistance of the dry, skin surface is relative high, in the range of 20,000 to 30,000 ohms; whereas resistance of damp skin or subdural layers may be lower than 500 ohms. See Robert Berkow, "The Merck Manual, 15th Ed.," (1987) Merck, Sharp, & Dohme, Rahway, N.J., Chapter 258, which chapter is herein incorporated in its entirety by reference.

Amperage, power, pulse frequency, and lastly, voltage determine the effectiveness of electrical shock in disabling any target individual. A disabling, sub-lethal electrical shock does not require a high total energy level. Shocks in the range of 5 to 30 watts are generally disabling when the power is pulsed at rates of from 2 to 40 discharges per second, with rates around 20 being recognized as effective. For reasonable effectiveness, two or more pulsed discharges of 3 to 15 seconds are recommended. Long wavelength electricity 40 to 80 Hz is the most effect. Serious damage to the heart can result from shocks with power delivered at 60

Hz. When the power is delivered below the surface of the skin, for example by using electrodes that penetrate the skin and remain embedded, as a result of the previously noted low resistance of the subdural tissue, potential in the range of 100 to 350 volts is adequate to generate a disabling shock. Thus, electrical shocking devices that are specifically designed to penetrate the skin require significantly lower power levels (voltage) than those designed to discharge at the skin's surface or through clothing. High voltage tends to cause more immediate pain and tissue damage due to the heat generated by the voltage; thus, even for a sub-lethal or non-lethal device, penetrating the skin may be viewed as preferable to high voltage injuries to target individuals.

The low frequency (long wavelength) disabling shock can be combined as a carrier frequency with high frequency (short wave length) power. The combination reduces the more serious effects of the low frequency discharge on the heart. ?In addition, high frequency power has a more specific effect on disabling the central nervous system.

DESCRIPTIONS OF PREFERRED EMBODIMENTS

EXAMPLE 1

Figure 1:
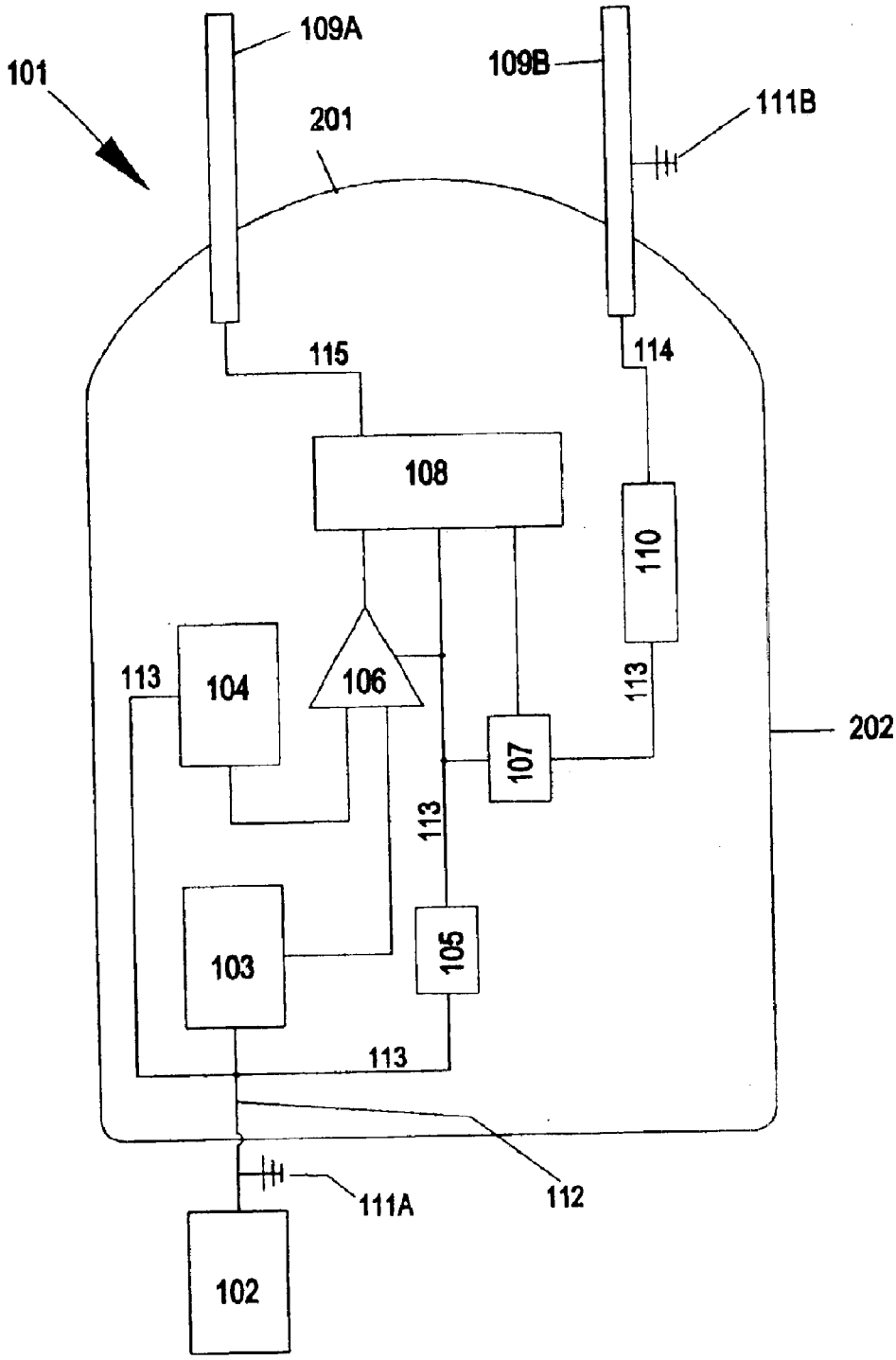
FIG. 1 is a box diagram of an electrical circuit capable of delivering a disabling electric shock by means of a wireless projectile.

FIG. 1 illustrates the shock delivery circuit 101 and comprises at least nine basic components. The external basic DC power source 102 capable of supplying a power potential of from 3 to 15 DC volts powers the circuit but is physically separated from it and therefore not considered to be part of the circuit as the circuit ultimately functions in a wireless projectile; (1) a first oscillator 103 capable of creating a frequency of from 15 to 50 Hz; (2) a second oscillator 104 capable of creating a frequency of from 250 to 500 kHz; (3) a capacitor 105 capable of storing and discharging electrical energy to provide three or more discharges of eight or more seconds delivering a pulsating shock of from 5 to 30 watts with non-discharge periods of up to 3 seconds between the discharges; (4) a control and amplifying unit 106 capable of combining the frequencies delivered by the first oscillator 103 and the second oscillator 104 and of stepping-up the potential of the electrical energy delivered initially by the basic DC power source 102 to 100 to 400 volts. In an alternate configuration, the potential step-up function of the control and amplifier unit 106 may be assumed by an independent transformer electrically positioned between the basic DC power source 102 and a point 112 at which the input electrical conductor 111A is connected to the circuit 101; (S) a timing circuit 107 capable of regulating both the pulse rate of discharges between 2 and 45 pulses per second and the duration of discharges, between 5 and 15 seconds; (6) an analog switch 108 capable of regulating the flow of current to a first electrode 109A; (7) a proximity sensor 110 that maintains the system in an inactive (no current flow) when open, and is capable of closing and thereby allowing current flow when the first electrode 109A and the second electrode 109B are in close proximity or contact with the skin of a target individual; (8) a common ground for the entire circuit 111B; and (9) a rapidly detachable jack connecting the basic DC power source 102 to the circuit 101 at a point 112. Depending on the means used to deliver the projectile 201 in which the circuit 101 is positioned, the point 112 and jack may be on the projectile or on a cartridge casing in electrical communication with the circuit 101. The perimeter or body of the wireless projectile 202 in which the circuit 101 is positioned is also illustrated.

The function of the shock delivering circuit 101 is most readily explained starting with the analog switch 108 and proximity sensor 110 open. All components of the shock delivery system, except the first electrode 109A and the second electrode 109B are fully energized by power from the basic DC power source via the electrical distribution power line 113 and maintain a full charge when disconnected from the basic DC power source 101. The open analog switch 108 and proximity sensor 110 prevent power flow to the first electrode 109A and second electrode 109B, respectively.

EXAMPLE 2

Figure 2:
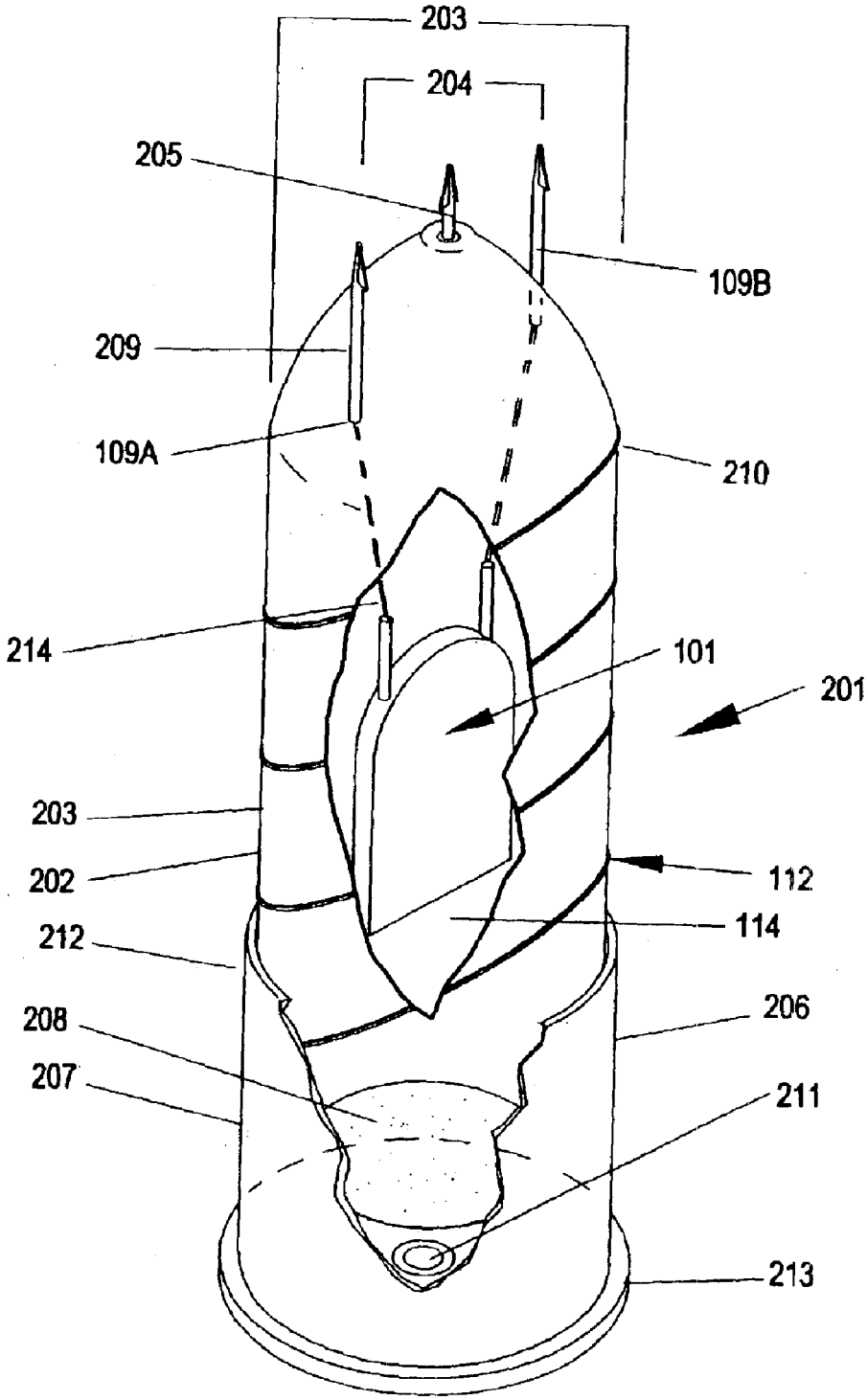
FIG. 2 is a diagram of a wireless projectile designed as a means to deliver a circuit capable of delivering a disabling electric shock and further designed to be discharged from standard devices such as a shot gun or emergency flare pistol.

An embodiment of the invention illustrated in FIG. 2 anticipates delivery of the electrical circuit capable of delivering a disabling electrical shock by means of a projectile 201 capable of being at least partially inserted into a casing 206 in the manner comparable to the manner in which a bullet is seated in the casing for ammunition commonly used with fire arms. The distal end 208 of the projectile is inserted into the proximal end 212 of the casing 206. The casing 206 has an explosive or combustion chamber 207 that holds a charge of gun powder or comparable explosive. Wading (not shown) may separate the distal end 208 of the projectile from direct contact with the explosive charge and serve to ensure proper combustion of the charge. The distil end 213 of the casing is adapted to receive a standard, center fire primers 211. The projectile 201 is fabricated from any of several materials, such as plastic, hard rubber. The projectile is adapted to allow the entire circuit 101 to be positioned in the interior core 214 of the projectile 201. As illustrated, the jack connecting point 112 is located on the perimeter 202 of the projectile 201 outside of the casing 206. Riflings 210 are molded on the surface 203 of the projectile 201 to enhance stability in flight and accuracy of the projectile. The rifling may be omitted when the projectile is specifically designed to be fired from a weapon with a rifled barrel. This modification does not change the scope nature or intent of the invention.

The proximal end 204 of the projectile 201 terminates in a solid, barbed probe-like structure 205. The probe-like structure extends approximately 0.64 cm (0.25 in) to over 2.54 cm 1.00 in) beyond the tip 209 of the projectile 201 and extends beyond the tip of the first electrode 109A and second electrode 109 B both of which extend beyond the tip of the projectile 209. To help minimize arcing between electrodes, the tip of the first electrode is separated from the tip of the second electrode by a space of 2.0 cm (0.75 in). The barbed, probe-like structure functions to penetrate the clothing and skin of a target individual and attach the projectile to the target individual. The first electrode and second electrode are designed to penetrate the skin of the target individual and to help secure the projectile to the target individual. The disabling shock results from the circuit between the electrodes being completed when the electrodes penetrate the skin of the target individual.

The diameter of the projectile 203 varies from approximately 0.60 cm (0.25 in) to 5.00 cm (2 in) or more. A diameter of approximately 1.27 cm (0.50° in) is appropriate for discharging the projectile from hand held weapons. The invention anticipates modification of both the diameter of the projectile and type and design of casing to utilize existing types of weapons and to be used with specifically designed weapons. The projectile weighs, but is not limited to, from 0.40 to 0.60 kg (1.0 to 1.5 lb). Discharged at a velocity of approximately 70 m (200 feet) per second, the physical contact of the projectile delivers a physically stunning blow to the target individual.

EXAMPLE 3

Figure 3:
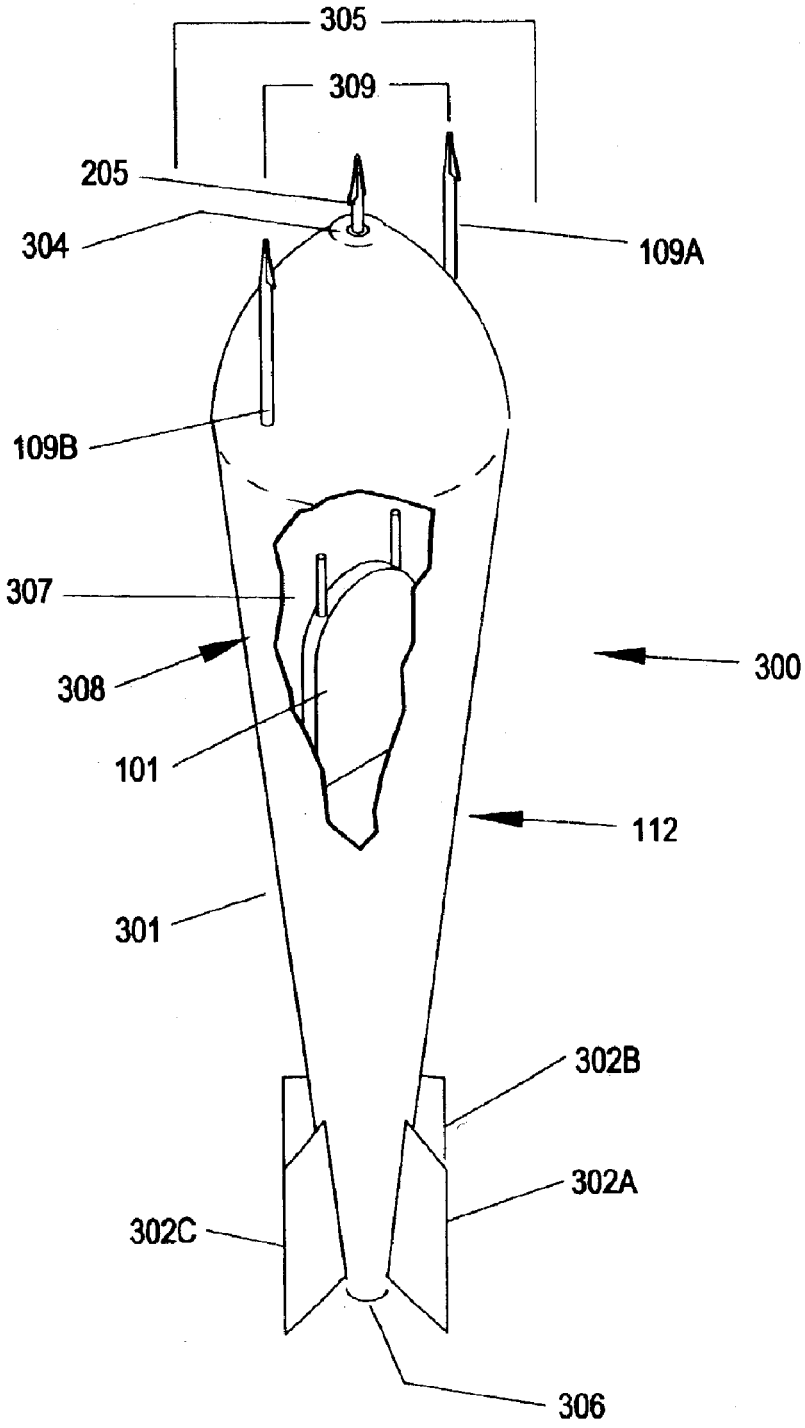
FIG. 3 is a diagram of a wireless projectile designed as a means to deliver a disabling electrical shock and further designed to be discharged as a dart from a spring powered or pneumatic device or thrown by hand.

An alternative embodiment of the invention is described in FIG. 3. A wireless projectile 300 is adapted for being discharged from a wide array of pneumatic and spring powered weapons with smooth bore barrels, or to be thrown by hand under certain conditions. Unlike the device of FIG. 2, the device of FIG. 3 does not include a cartridge and chamber for an explosive propellant. The profile of the device 300 is variously described as cigar-shaped, torpedo-like, or dart-like. The body 301 has a rounded proximal, or front end 304, with a tapering distal end 306. A plurality of fins, as illustrated, three fins 302A, 302B, and 302C, are fixed to the surface 301 of the distal end 306 of the body 301 of the projectile.

The body 308 of the projectile is fabricated from plastic or hard rubber, although as in the case for the projectile of FIG. 2, other materials may be used including certain ceramics and even paper materials. The core 307 of the projectile is adapted to support the electric circuit element 101. The proximal end 304 of the projectile 300 terminates in a probe-like element 205 that extends 2.54 cm (1.0 in) or more from the proximal end 304. The first electrode 109A and the second electrode 109B extend from near the proximal end 304 of the projectile 300. The functions and relationships of the probe-like structure 205 and first electrode and second electrode are comparable to those described for the projectile of FIG. 2 and will not be repeated. The maximum diameter 305 of the projectile 300 varies from 1.25 cm (0.50 in) to over 5 cm (2.00 in) although these dimensions are not absolute limits. In a preferred embodiment, the diameter 305 is that of a cylinder bore, 12 gauge shotgun.

EXAMPLE 4

Figure 4A:
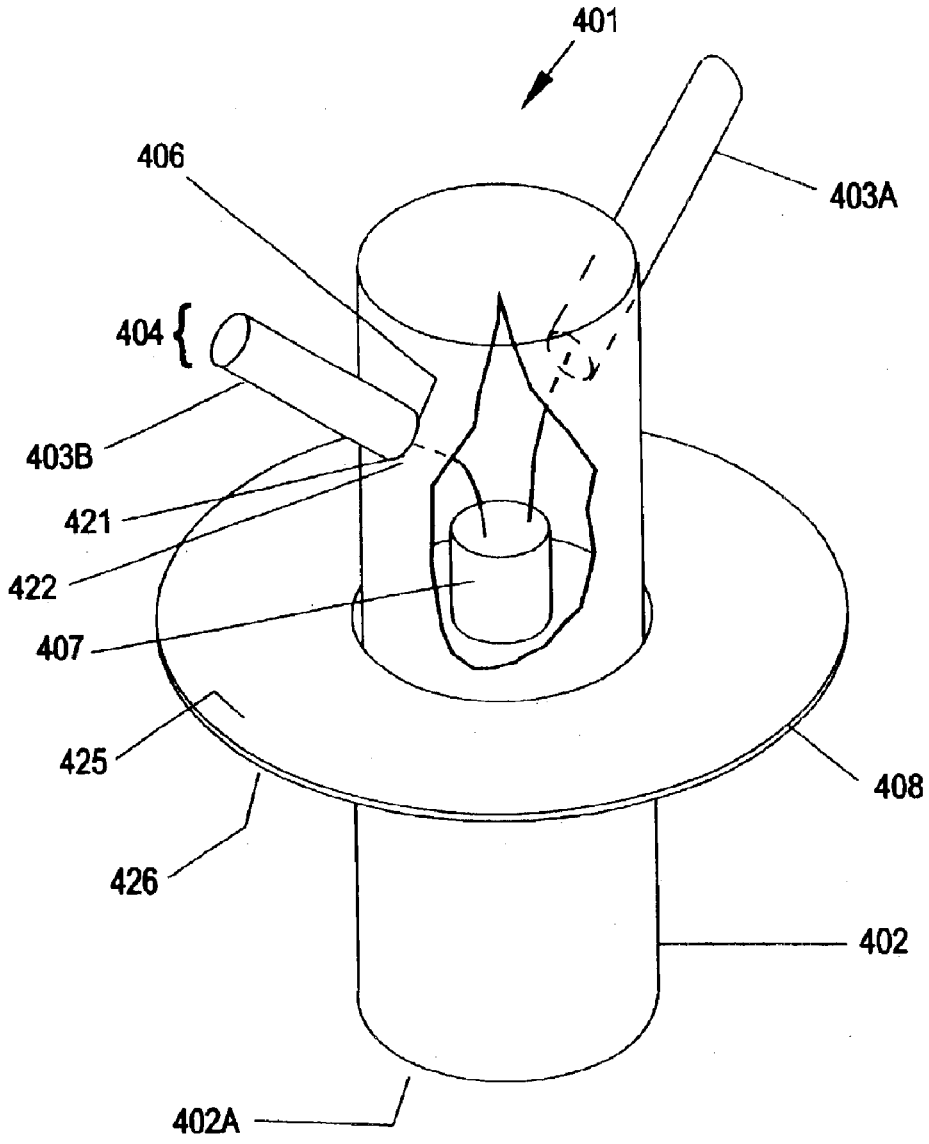
FIG. 4A illustrates a devise to discharge wireless electrical projectiles from remotely positioned, ground emplacement.
Figure 4B:
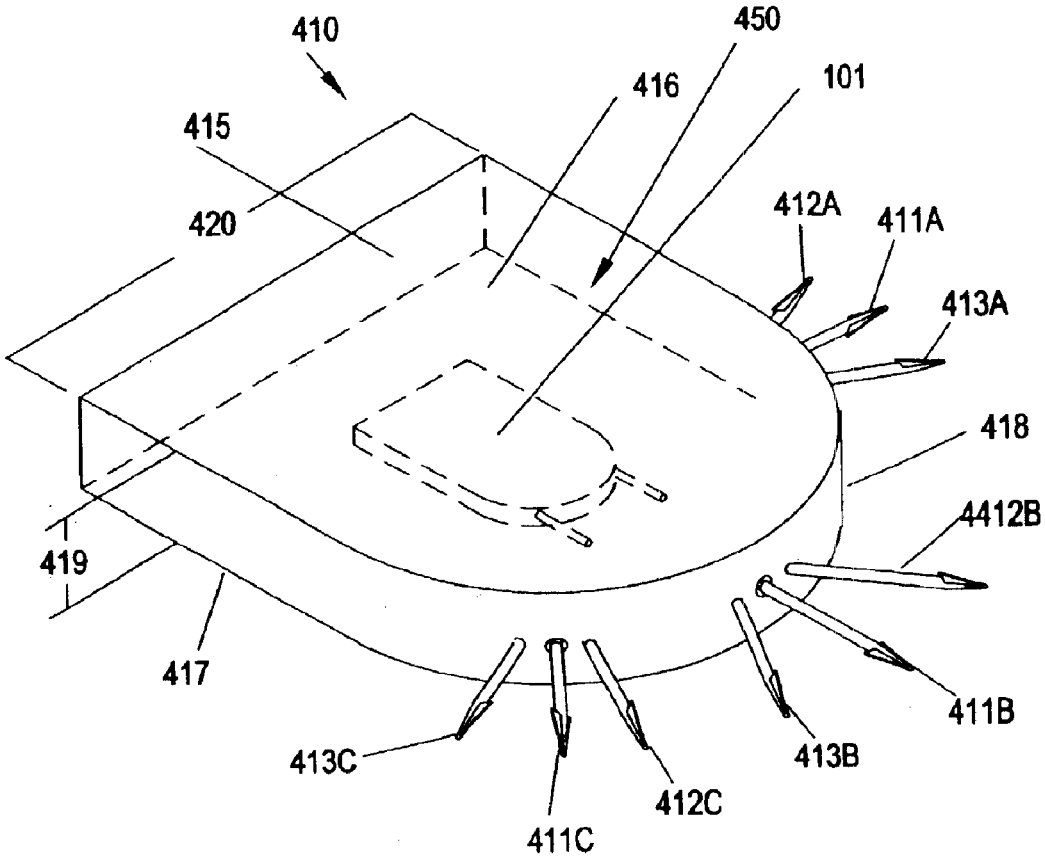
FIG. 4B illustrates an appropriate projectile for use in the fixed ground emplacement device.
Figure 4C:
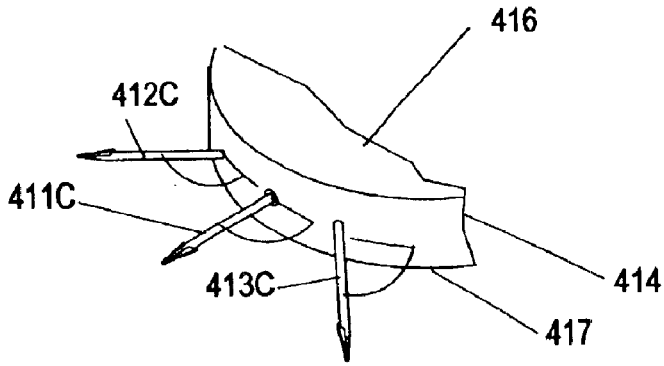
FIG. 4C illustrates details of the projectile.

FIGS. 4A, 4B, and 4C combine to illustrate a device or modified weapon to launch a wireless projectile 410 from a fixed ground location so as to provide perimeter protection to a specific location or facility by use of a disabling electric shock to a target individual delivered by the projectile. A projectile for use in the weapon is also described. The basic weapon 401 comprises three major elements: an outer sleeve 402 with a solid base 402A fixed to the sleeve; an inner sleeve 405 designed to move vertically within the outer sleeve and powered by pneumatic or mechanical means; a plurality of barrel elements 403A and 403B are removeably attached to the inner sleeve 405. FIG. 4A illustrate a device with only two barrel elements. The barrel elements may be attached by threads to the inner sleeve. The cross section shape and maximum dimension 404 of the barrel elements 403A and 403B are effectively the same as the shape and maximum dimensions of the wireless projectile 410 described by FIG. 4B such that the wireless projectile 410 when placed in the distal end 421 of a barrel element and the barrel element closed by with its cap 422 forms a nearly air tight seal with the barrel element. Each barrel element may be removed for loading with a projectile, or as an alternative, each barrel element may be loaded through its proximal end. In this mode, the barrel may be permanently fixed to the inner sleeve, rather than threaded to it. A source of compressed gas 407 is connected to the cap 422 of each barrel element such that the gas can be released to propel the projectile from the barrel element. The entire device 401 is positioned in a small silo 425 such that when the inner sleeve 405 is fully retracted into the outer sleeve 402 the entire device is at or slightly below the soil surface 426. A plurality of devices may be arrayed to protect a defined area, and the inner sleeve and connected barrel elements elevated remotely or in response to a remotely sensed intrusion. Each barrel element of each device may be triggered by a trip-line, remote control in response to a warning, or remotely by the same type of condition that caused the elevation of the inner sleeve. The range of the projectile when fired and the elevation are determined by the weight of the projectile, the force applied to discharge or fire the projectile, and the angle of the barrel in relation to horizontal.

The wireless projectile 410 of FIG. 4B comprises a body 450, with an upper surface 416, a lower surface 417, a front edge or leading surface 418, a back surface 415, a thickness 419, a perimeter wall 414, and a maximum width 420. A plurality (three as illustrated) of barbed, probe-like elements 411A, 411B, and 411C are positioned along the front, or leading edge 418 of the body 450. The barbed, probe-like elements contact a target individual and penetrate the clothing and skin and physically serve to attach the wireless projectile 410 to the target individual. In addition a plurality of pairs of electrodes 412A/413A, 412B/413B, and 412C/413C also extend from the leading edge 418 of the projectile 410. Members of each pair of electrodes are electrically connected to and part of the electrical circuit 101 which is positioned in the core 450 of the body of the projectile. The electrodes are wired such that any two electrodes of opposite polarity that penetrate the skin will complete a circuit and thereby deliver the disabling electric shock generated by the electric circuit as described in Example 1. The body may be fabricated from any of a variety of materials, with preference given to plastic and hard rubber. The probe-like elements 411A, 411B, and 411C and all electrodes are made from conductive material that is stiff, but that can be reflexed, or bent backwards against the perimeter wall 414 and held in this position until the projectile is discharged from the barrel element at which time they spring to their normal, effective position.

FIG. 4C illustrates a single pair of electrodes 412C/413C and the corresponding probe-like structure 411C in the reflexed position as they would appear when the projectile is positioned in a barrel element and in their normal position. With the electrodes and probe-like elements reflexed, a reasonable air-tight seal is formed between the barrel element and wireless projectile such that the propellant gas acts to propel the projectile and does not merely escape around the edges of the projectile in the barrel element.

EXAMPLE 5

Figure 5A:
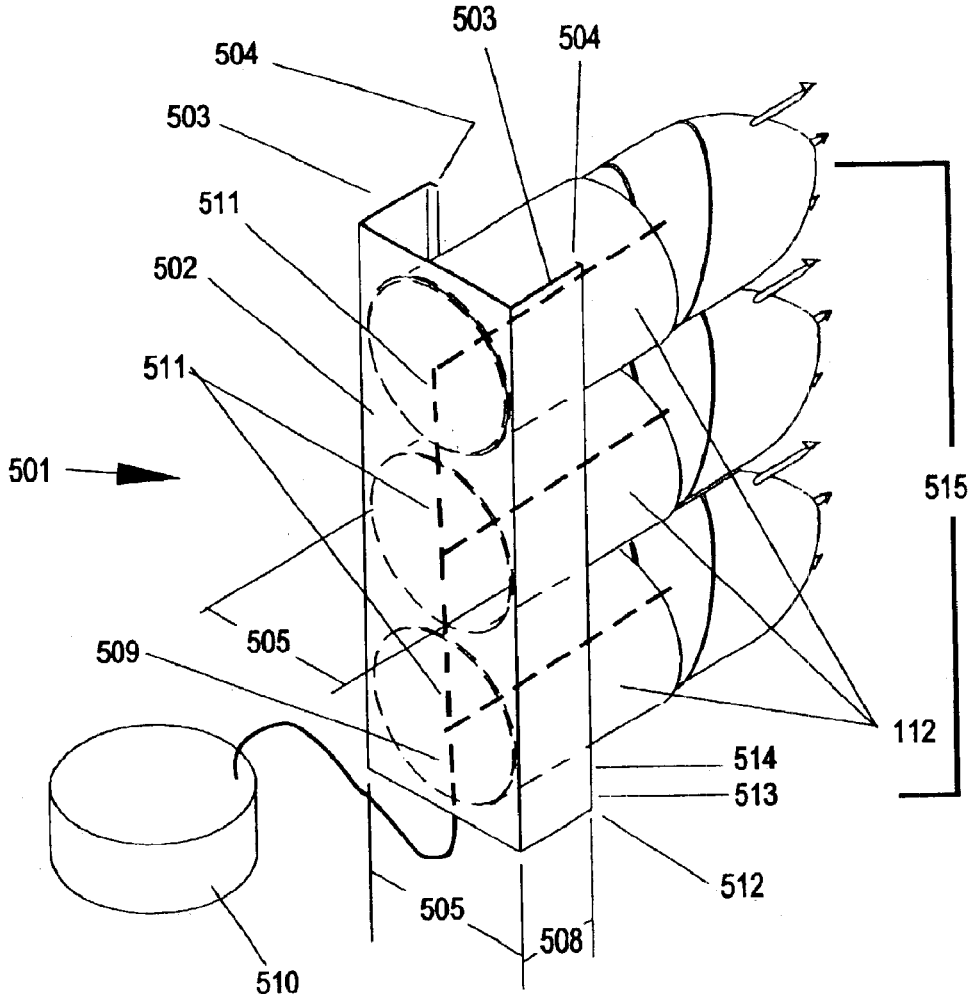
FIG. 5A illustrates a device to store and continuously charge a wireless projectile cartridge in which the device may also function as a magazine for loading a weapon.
Figure 5B:
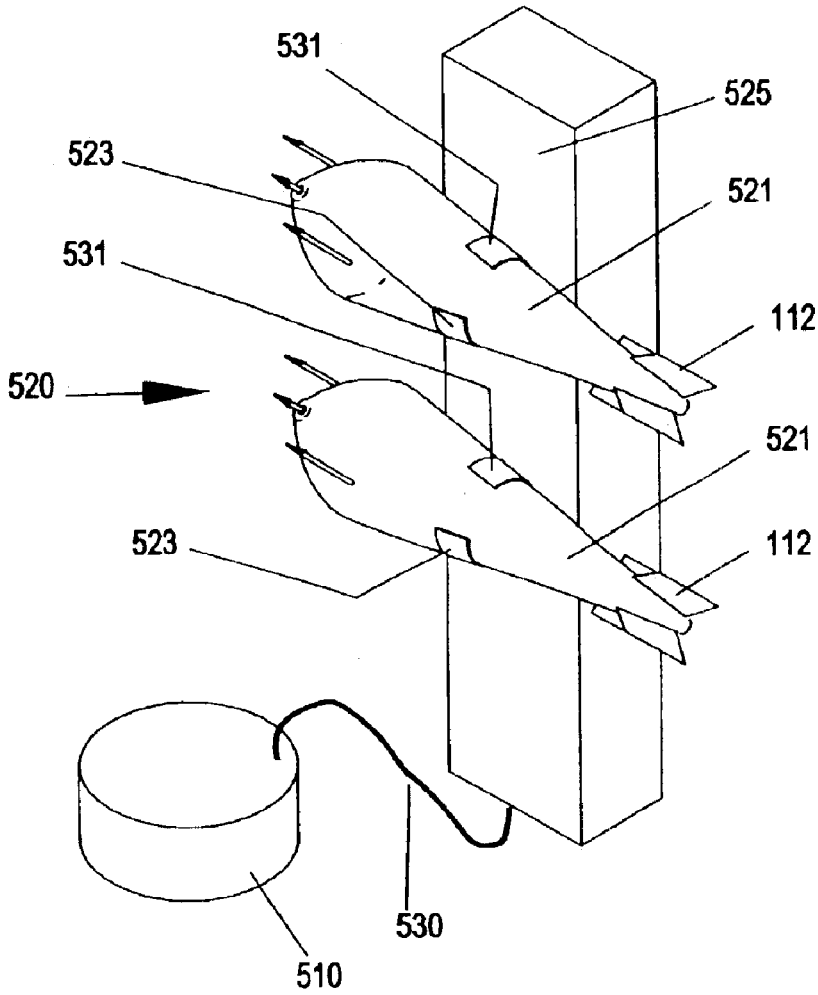
FIG. 5B illustrates a partial alternative to the device of FIG. 5A.

FIG. 5A and FIG. 5B illustrate variations of a device that serves two purposes: convenient, rapidly accessible storage of the wireless projectile or of a cartridge with such a projectile seated in it and a device that allows the wireless projectiles electrically connected to an independent DC charging source so as to ensure that a projectile maintains an adequate charge to deliver a disabling electric shock to a target individual. In addition the device of FIG. 5A is adapted to function and serve as a magazine 501 that allows loading a weapon with more than a single wireless electrical projectile.

The magazine device 501 of FIG. 5A is a simple structure comprising a back element 502 and narrow side elements 503, the side elements being deflected 504 slightly inward to hold the distal end of a cartridge. The width 505 of the back element 502 is effectively the diameter of the base of the cartridge 505. The width 508 of the side elements 503 is not critical, but must be greater than the thickness of the base of the cartridge so that the inward deflection of the side elements holds the cartridges laterally in place.

A simple wiring yoke 509 is positioned in the magazine with an electrical lead connecting the magazine to an independent source of DC power 510 which is not a required part of the magazine. Individual leads 511 branch from the yoke and to the wireless projectile at the jack connection point 112. The overall length 515 of the magazine is a function of the diameter of the cartridges and number of cartridges held. A bottom element 512 connected to back element 502 and to the side elements prevents cartridges from slipping vertically from the magazine.

When used as a magazine to allow loading a weapon with more that a single cartridge, the magazine of —FIG. 5A includes a spring 513 that rests on the bottom element with a follower element positioned on the upper end of the spring. The spring 512 is depressed by cartridges placed in the magazine and exerts an upward force on the cartridges in the magazine. Deflection of the upper end of the magazine prevent cartridges from being ejected from the magazine, and operation of the weapon moves the cartridge from the magazine into the weapon for subsequent discharge.

The alternate device 520 serves only to store and provide a charging position for wireless projectiles. It is specifically adapted for dart-shaped projectiles 521, although the use is not limited to such projectiles. The body of the device 522 is fabricated from any of a variety of materials, including plastics and wood. For convenience, relatively light material is preferred. Pairs of spring clips 523 are positioned on the face 525 of the body 522. The pairs of clips are adapted to supporting a wireless projectile 521. A simple wiring yoke 530 connects the device 520 to a source of DC power 510. The yoke 530 extends through the body 522 of the device and is connected through one member of a pair of spring clips 523 to the wireless projectile 521 at the jack connection point 112.

The magazine of FIG. 5*a* and device of FIG. 5*b* may be connected to a power source carried by security officers to power other equipment and thereby be fully portable, or they may be connected to vehicle or building power sources.

What is claimed is:

1. A wireless projectile comprising:

a. an electric circuit capable of producing a first, carrier frequency of from 250 to 500 kHz and further capable of concurrently producing a second frequency of 15 to 50 Hz; said electric circuit further being capable of regulating said first carrier frequency to deliver discharges of from 2 to 45 pulses per second with an initial discharge of from 2 to 8 seconds duration, and at least 2 subsequent discharges of at least 3 seconds duration each, said electric circuit also being adapted to receiving and storing electrical energy supplied at 1.5 volts to 15 volts by an independent power source, and said electric circuit terminating in at least one pair of electrodes, wherein each member of said at least one pair of electrodes is capable of penetrating the skin of a target individual and capable of delivering a disabling electric shock to said target individual, said disabling shock being produced by charged elements of said electric circuit and being from about 250 volts to 400 volts and from 3 amps to 15 amps, and said disabling shock being transmitted concurrently by said first carrier frequency and by said second frequency at a pulse rate of from 2 to 45 pulses per second, and said electric circuit being activated by a proximity sensor and analog switch in electrical communication with said members of said at least one pair of electrodes; and b. a projectile comprising a body made from a material and a longitudinal inner core defined by the outer wall of said projectile body, wherein said longitudinal core is capable of receiving and positioning said electric circuit, said projectile having a length, a diameter, a distil end and a proximal end and said projectile body further being adapted to being inserted into a casing to form a cartridge.

2. The wireless, sub-lethal projectile of claim 1 wherein said electrodes and said cylindrical body are fabricated from material that will not penetrate material such as the exterior skin layer of commercial aircraft.

* * * * *